United States Patent [19]

Evora

[11] 4,372,585

[45] Feb. 8, 1983

[54] SLEEVE PROTECTOR FOR VENTING PIPES

[76] Inventor: Victor Evora, 2209 NW. 5th St., Miami, Fla. 33125

[21] Appl. No.: 231,216

[22] Filed: Feb. 2, 1981

[51] Int. Cl.[3] ..... E04D 13/14

[52] U.S. Cl. ..... 285/43; 285/158; 285/331; 52/58; 52/219; 138/96 R

[58] Field of Search ..... 98/61, 122; 138/96 R, 138/96 T; 52/58, 219; 285/42, 43, 158, 331

[56] References Cited

U.S. PATENT DOCUMENTS

| | | | |
|---|---|---|---|
| 1,062,039 | 5/1913 | Schimmel | 138/96 T |
| 1,642,330 | 9/1927 | Brownstein | 138/96 T |
| 2,543,960 | 3/1951 | Elmer | 138/96 T |
| 3,305,120 | 2/1967 | Owen | 138/96 R X |
| 3,436,880 | 4/1969 | Kifer | 138/96 R X |
| 4,146,058 | 3/1979 | Bercovitz | 138/96 R |
| 4,185,665 | 1/1980 | Flimon | 138/96 TX |

FOREIGN PATENT DOCUMENTS

| | | | |
|---|---|---|---|
| 221530 | 6/1942 | Switzerland | 52/58 |

*Primary Examiner*—Albert J. Makay
*Assistant Examiner*—Harold Joyce
*Attorney, Agent, or Firm*—Jesus Sanchelima

[57] ABSTRACT

A sleeve protector for venting pipes comprising a tubular member attached on one end to a flat portion in an angle that follows the slope of the roof where it is being used and a protector cap reciprocally mounted on the other end of said tubular member and having a plurality of annularly spaced clamps adapted to lock to the ribs formed on the outside wall of said tubular member.

2 Claims, 4 Drawing Figures

FIG. 1.
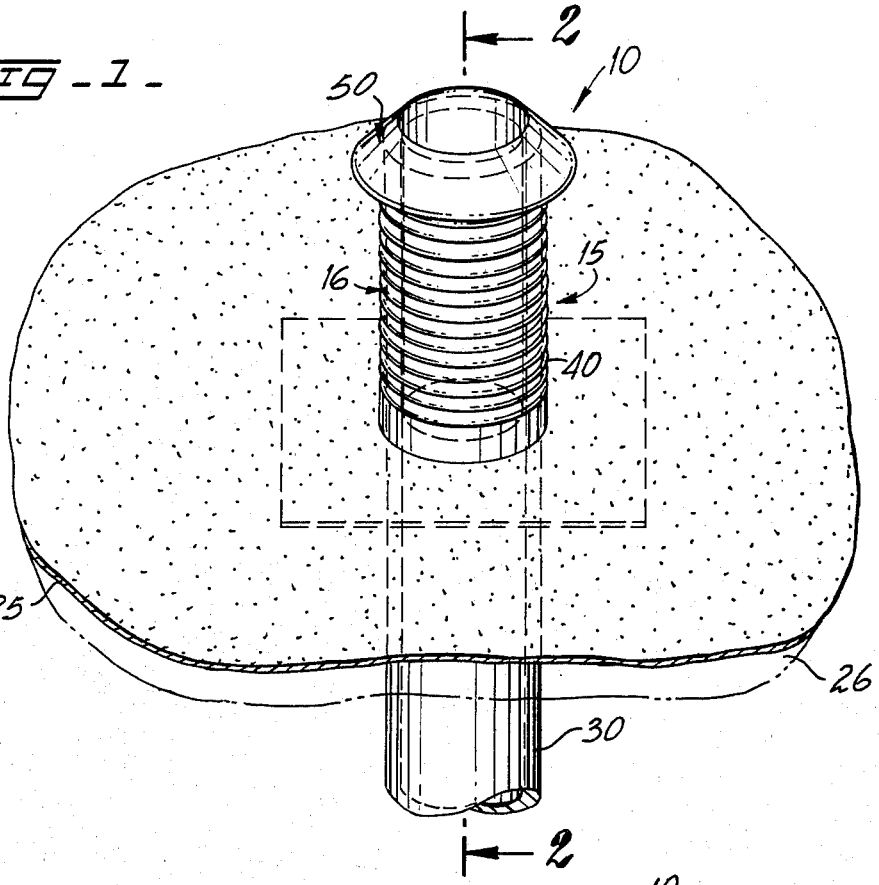
FIG. 2.
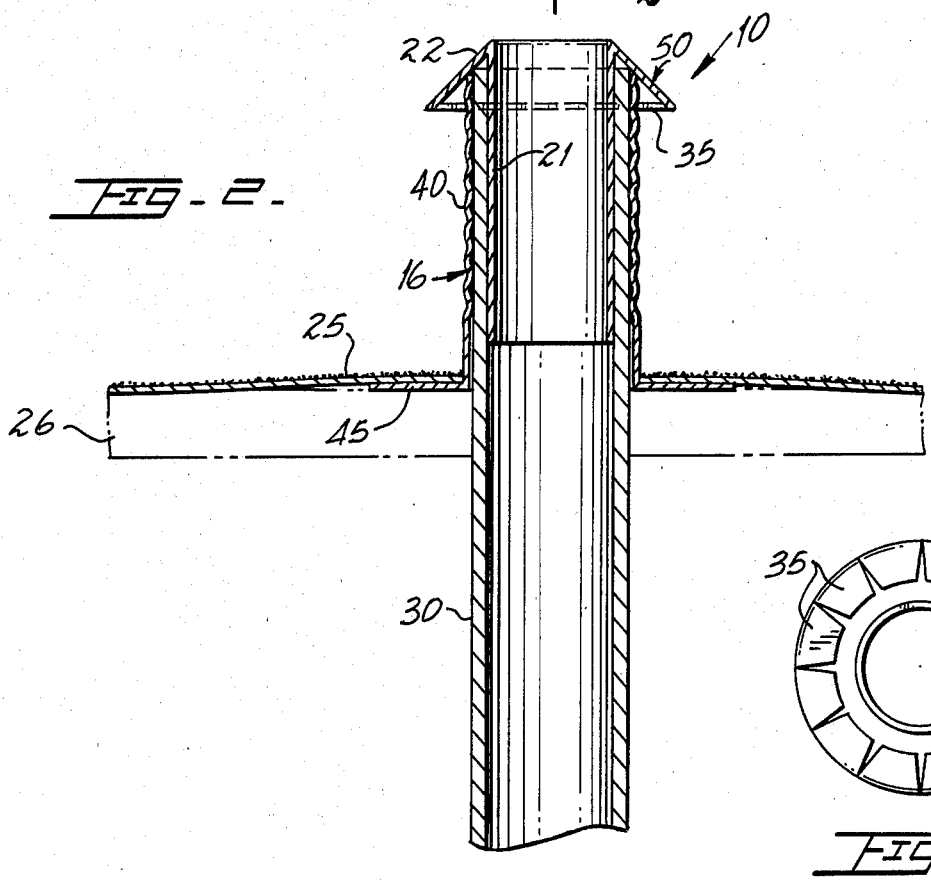
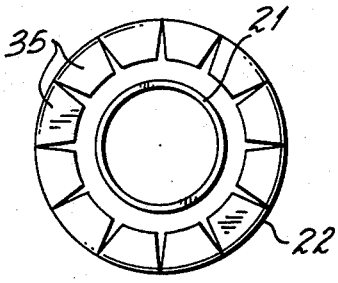
FIG. 3.

SLEEVE PROTECTOR FOR VENTING PIPES

BACKGROUND OF THE INVENTION

1. Field of the Invention

This invention relates to protectors for venting pipe terminations, and more particularly, to a sleeve protector that sandwiches the pipe being protected preventing its accidental or intentional damage.

2. Description of the Prior Art

Most building codes require the sewage pipes to be connected to venting pipes in order to avoid trapped gases from causing deterioration of the sewage pipes and stoppages.

These venting pipes are flashed with lead sleeve-type flashing, usually, because it is easier to work and mold to the required shape. The closest prior art found is U.S. Pat. No. 3,363,538 issued to Harold Stoneman. Here, a vandalproof vent protector is disclosed. This device provides a sturdy protector but it makes it very difficult for plumbers to work when a snake is needed to unclog the sewage pipes. It is also very complicated and expensive to manufacture.

Another attempt to improve the terminations of vent pipes is disclosed in U.S. Pat. No. 510,884 issued to Bradley, Jr. Bradley's cap is also considerally more complicated and diffilcult to install than the present invention.

Other patents describing the closest subject matter provide for a number of more or less complicated features that fail to solve the problem in an efficient and economical way. None of these patents suggest the novel features of the present invention.

SUMMARY OF THE INVENTION

It is the main object of this invention to provide a sturdier protection for the terminations of venting pipes protruding through the roofs of modern building structures.

It is another object of the present invention to provide an easy to install sleeve protector for venting pipes that can not be diformed easily when plumbers use their tools, particularly the snake, to unclog these pipes.

It is yet another object of the invention to provide a protector for venting pipes that is not susceptible to damage when accidentally hit by roofers or another person working on the roof.

It is still another object of this invention to provide a protector that is vandalproof.

Further objects of the invention will be brough out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings, in which:

FIG. 1 is an inclined view of the sleeve protector.

FIG. 2 is a side cross-sectional view of the sleeve protector along line 2—2.

FIG. 3 is a top view of the protector's cap.

DESCRIPTION OF THE PREFERRED ENBODIMENT

Figure 4:
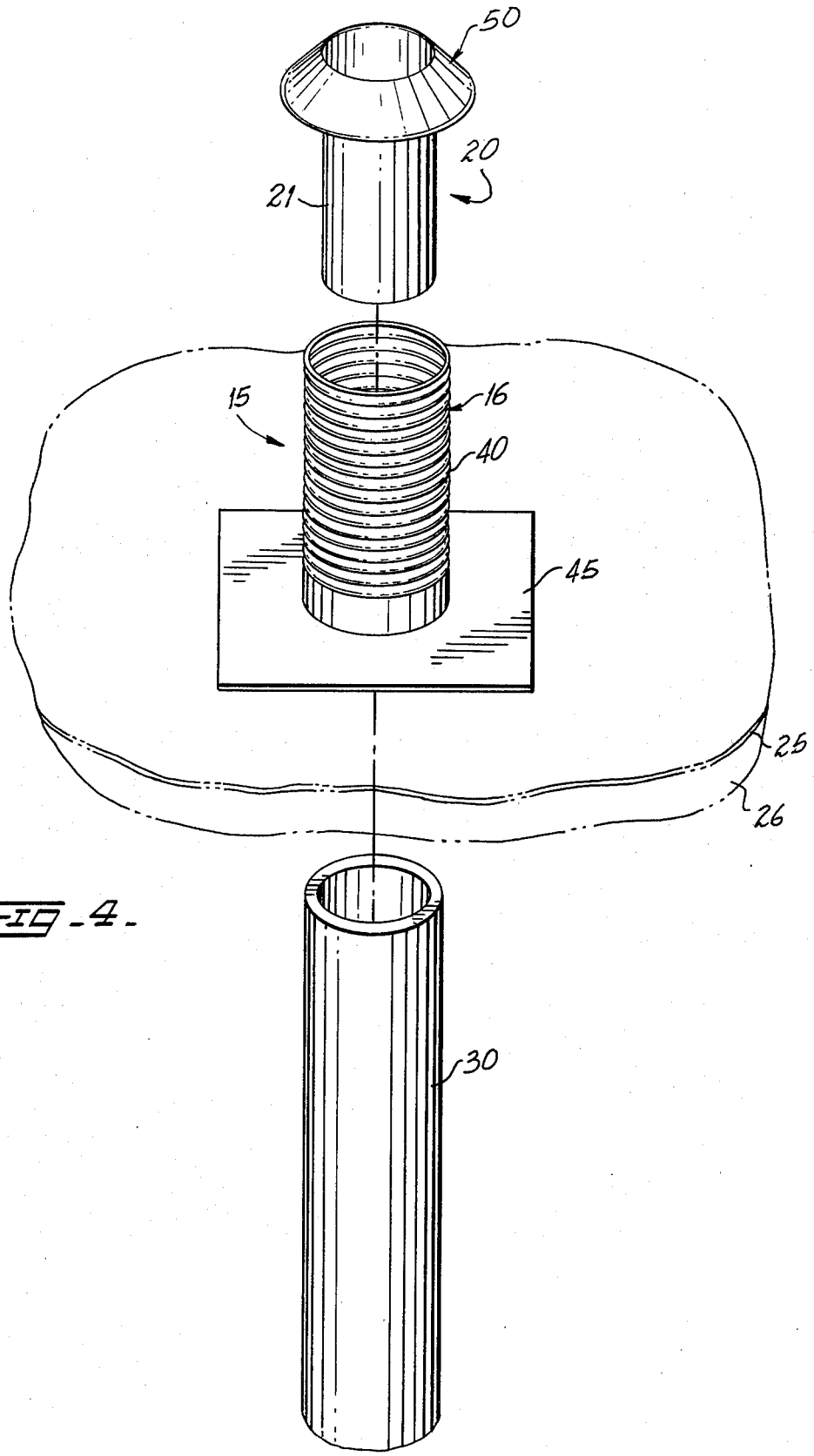
FIG. 4 is an exploded view of the sleeve protector's components.

The sleeve protector device is referred to generally as numeral 10 and comprises two main elements: a tubular member 15 and a cap member 20. These two pieces are shown in an exploded perspective view in FIG. 4. Basically, tubular member 15 consists of a hollow cylinder 16 provided with a plurality of ribs 40 on the outer wall of said cylinder 16. The diameter of said cylinder 16 is of a suitable size to allow venting pipes 30 to pass through. The diameter for venting pipes 30 is usually specified by applicable building codes. A flat portion 45 is provided with a hole of the same diameter as said cylinder 16 which is attached or soldered to the circular periphery that defines said hole. This flat portion is positioned between the roof deck 26 and the roof membrane 25. Usually, asphalt or any other suitable glue compound is used to insure water tightness. A cap member 20 consists of a second hollow cylinder 21 and a headed termination 50. The second hollow cylinder 21 having a diameter smaller than said hollow cylinder 16. The difference between said hollow cylinders 16 and 21 is enough to allow the venting pipes 30 to be sandwiched between said hollow cylinders. The headed termination 50 has the shape of a truncated cone 22 and its base has a plurality of clamps 35 which are formed by bending the edge of said cone base inwardly. The function of these clamps 35 is to provide an effective engagement with the ribs 40 on said hollow cylinder 16.

The installation of the sleeve protector 10 is a relatively easy job. First, tubular member 15 is placed over venting pipes 30, so that hollow cylinder 16 surrounds pipe 30. Flat portion 45 attach to cylinder 16 prevents any leaks through the interface of the roof 25 and pipe 30. Once tubular member 15 is properly positioned, cap member 20 is inserted inside pipe 30, as shown in FIG. 2. Cap member 20 will be driven down as far as the inner wall of cone 22 and the upper end of cylinder 16 will allow. Clamps 35 will interlock with ribs 40 thereby providing a sturdy protection of pipes 30 against accidental or intentional tampering.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A sleeve protector for venting pipes with circular cross-section and protruding through the roof of a building comprising, in operative combination:

(a) a tubular member including a hollow cylinder attached to a flanged flat portion on one end and said cylinder being provided with a plurality of circumferential ribs on its outer wall, and said tubular member adapted to receive said protuding venting pipes, and (b) a cap member including a second hollow cylinder and a headed termination attached to one end of said second cylinder having substantialy the shape of a truncated cone with the larger base of said cone being provided with a plurality of inwardly extending clamps in interlocking cooperation with said ribs so that said cap member can be driven in and locked permanently in position.

2. The sleeve protector set forth in claim 1 wherein said flat portion attached to said hollow cylinder follows the inclination angle of said roof.

* * * * *